United States Patent [19]

Knakrick

[11] Patent Number: 4,976,580

[45] Date of Patent: Dec. 11, 1990

[54] STORAGE MEANS, ESPECIALLY PARKING MEANS

[76] Inventor: Edward Knakrick, Schlachthausgässchen 6, 8900 Augsburg, Fed. Rep. of Germany

[21] Appl. No.: 332,453

[22] PCT Filed: Aug. 22, 1987

[86] PCT No.: PCT/EP87/00475

§ 371 Date: Feb. 16, 1989

§ 102(e) Date: Feb. 16, 1989

[87] PCT Pub. No.: WO88/01331

PCT Pub. Date: Feb. 25, 1988

[30] Foreign Application Priority Data

Feb. 22, 1986 [DE] Fed. Rep. of Germany ... 8620486[U]

[51] Int. Cl.[5] ..... E04H 6/00

[52] U.S. Cl. ..... 414/254; 414/256; 414/263

[58] Field of Search ..... 414/254, 255, 256, 260, 414/263, 283, 331, 787, 280, 282, 660, 661

[56] References Cited

U.S. PATENT DOCUMENTS

| | | | |
|---|---|---|---|
| 2,647,647 | 8/1953 | Alimanestiano | 414/254 |
| 2,840,248 | 6/1958 | Grove et al. | 414/256 |
| 3,063,579 | 11/1962 | Alimanestiano | 414/254 |
| 3,419,162 | 12/1968 | Hagel | 414/255 X |
| 3,618,793 | 11/1971 | Courtsey | 414/254 X |
| 3,664,523 | 5/1972 | Hagel | 414/255 |
| 4,039,089 | 8/1977 | Kochanneck | 414/256 |
| 4,265,581 | 5/1981 | Ives et al. | 414/254 X |

FOREIGN PATENT DOCUMENTS

| | | | |
|---|---|---|---|
| 1208166 | 10/1970 | United Kingdom | 414/254 |

*Primary Examiner*—Joseph E. Valenza
*Assistant Examiner*—James R. Bidwell
*Attorney, Agent, or Firm*—McGlew & Tuttle

[57] ABSTRACT

A storage device for automatic storage of items such as vehicles including a deposit station and removal station. A plurality of storage stations are provided having a deposit and a removal opening. A transport device is provided for transporting the item from adjacent the deposit station to adjacent one of the plurality of storage stations. The transport device also takes the item from adjacent the storage station to adjacent the removal station. A transfer device is provided for transferring the items from the transport device to the storage stations. The transfer device includes a transfer grate having parallel grate arms connected to each other by a ty-bar, a lifting mechanism connected to the grate arms and a transversing mechanism including running gears for moving the transfer grate horizontally. The storage stations each have cooperating storage grates which have cooperating counter profiles for engagement with the transfer grates such that grate arms of the transfer grate fit in between the grate arms of the storage grate.

13 Claims, 18 Drawing Sheets

STORAGE MEANS, ESPECIALLY PARKING MEANS

FIELD OF THE INVENTION

The invention relates to a process for the storage and removal of vehicles in a parking structure, as well as to the parking structure The structure can also be used as a storage means for other purposes.

BACKGROUND OF THE INVENTION

For the solution of the parking space problem existing particularly in metropolitan areas mechanical parking devices of various shapes are known.

French Publication No. A 1 407 816 suggests a parking device with a movable platform and a transfer device in the shape of a liftable and lowerable transfer grate with grate arms extending in the longitudinal direction and movable in a transfer direction. The transfer grate is moved by means of a rope gear and the same gear also lifts and lowers it. According to this arrangement, it is necessary for the rolling surface, i.e. the floor in the area of the movable platform to have a slot allowing for the entrance of the ropes. The arms of the transfer grate are moved separately and their movements are controlled by a light barrier arrangement.

U.S. Pat. No. 3,497,087 shows a parking arrangement with a transfer device in the shape of a telescopic bogie wagon. The stations and the wagon have transverse arms consisting of over-mounted jibs (gibbets). The station and the transfer device do not have a solid floor. For the transfer of a vehicle at the deposit, storage and removal stations the telescoped bogie wagon is lifted and lowered by an elevator, the grates penetrating one another.

WO Publication No. A 86/02678 also features a parking device with transverse grates and a telecopable bogie wagon. The stations have guide rails for the wagon, but no solid floor.

AT-PS No. 246 046 shows a spiral storage system, wherein the vehicles are driven on a platform along a spiral path to the surrounding parking lots and then stored or picked up through a transfer device. It consists of a swivelable and height-adjustable gripping device which grips the front wheels of the vehicle to be moved, lifts them and moves the vehicle into or out of its parking space.

Other designs are known from the Merkblatt Stahl (information brochure steel) No. 211, "Parkbauten" (parking buildings) by the "Beratungsstelle fuer Stahlverwendung" (information center for the employment of steel), 2nd edition 1972. This reference discloses a Paternoster-elevator system which requires a large amount of time and energy, as all vehicles have to be moved for the parking and removal. Also, slide systems are described, wherein the vehicles are maneuvered from the deposit stations or entrances to elevators and from there to the parking spaces and back through gravity conveyors or conveying or hauling paths.

Another known system works with pallets, on which the vehicles are deposited for storage. The pallets are then moved to free parking spaces by means of floor conveyors. Due to the pallets this system is expensive. The system requires complicated construction and can only be realized in one-story car parks. The access time for the parking and removal of the cars is too long in all of the mentioned prior art.

SUMMARY OF THE INVENTION

Therefore, the invention has the task of creating a possibility for the faster, cheaper and more reliable parking and removal of goods, and especially of vehicles.

According to the invention, a storage arrangement is provided with several storage, deposits and removal stations. A transport device is provided, and a transfer device is provided. The transfer device has an actuated transfer plate with a multi-armed station grate. Station grates are provided in stations. Station grates are substantially identical to the multi-armed stationed grate. The grates have counter profiles for penetrating on another such that the transfer grate may be moved into the station grate and can be lifted and lowered through them. All of the grates have arms made from box or U-profile portions which are arranged spaced a distance from one another and parallel to one another in the longitudinal direction. The arms of the transfer grate are equipped with a running gear. The arms are connected to one another by means of a ty-bar or cross arm. The drive of the transfer grate acts on the ty-bar. The arms are provided with a lifting device separate from the drive and a transfer device for use during the transfer movement. The lifting device is provided so that it rolls along a solid floor in the individual stations.

According to an advantageous arrangement of the invention the arms of the transfer grates are cross-connected with regard to one another and are moved together by running gears. The transfer grate gains more stability and cannot cant while moved. The transfer grate rolls on a solid floor in the corrugation-shaped storage grates of the stations and of the transverse devices and can carry heavier loads than known devices. This arrangement is especially of importance when the load, such as a motor vehicle, is supported only by a few of the grate arms. Furthermore, the running gear and the lifting device are separated, which makes for more security during operation under load.

At least three running gears are arranged under the arms of the transfer grates for the achievement of a large carrying capacity.

The invention also allows for a wide range of variations in number and arrangement of the deposit and removal stations. The stations are universally usable due to their identical design and can be used for the deposit or the removal of vehicles according to choice With the arrangement of several of such stations and the optimization of the conveyor system with simultaneous vertical and horizontal movements preferably controlled by a computer the waiting time at the removal station can be minimized considerably.

The preferred embodiments of the storage device optimize the possibilities to adapt and change with regard to the given property situation and adjoining buildings. The parking units can be onestory or multistory buildings, they can have a round, square or rectangular shape and can be varied accordingly. The module construction system creates the possibility of later changes and a more advantageous cost-effectiveness ratio. It is advantageous for the module construction system that the deposit and the removal station are identical.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments o the invention are illustrated.

BRIEF DESCRIPTION OF THE DRAWINGS

In the drawings:

FIG. 33 is a front cross sectional view showing the details of the running gear arrangement;

DESCRIPTION OF THE PREFERRED EMBODIMENTS

Figure 1:
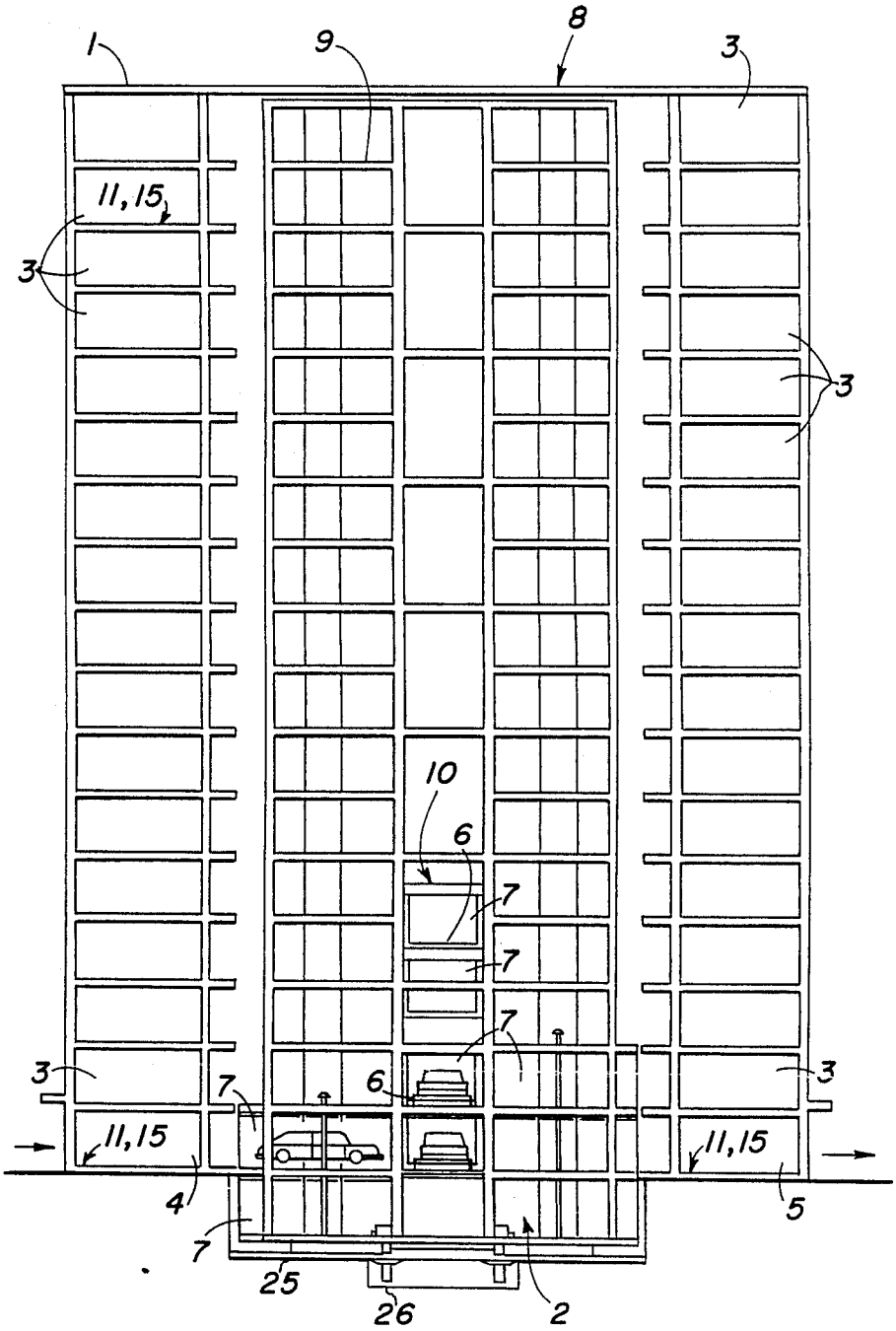
FIG. 1 is a front view of a parking device with several stations and a transport device for depositing, parking and removal of vehicles or items.
Figure 2:
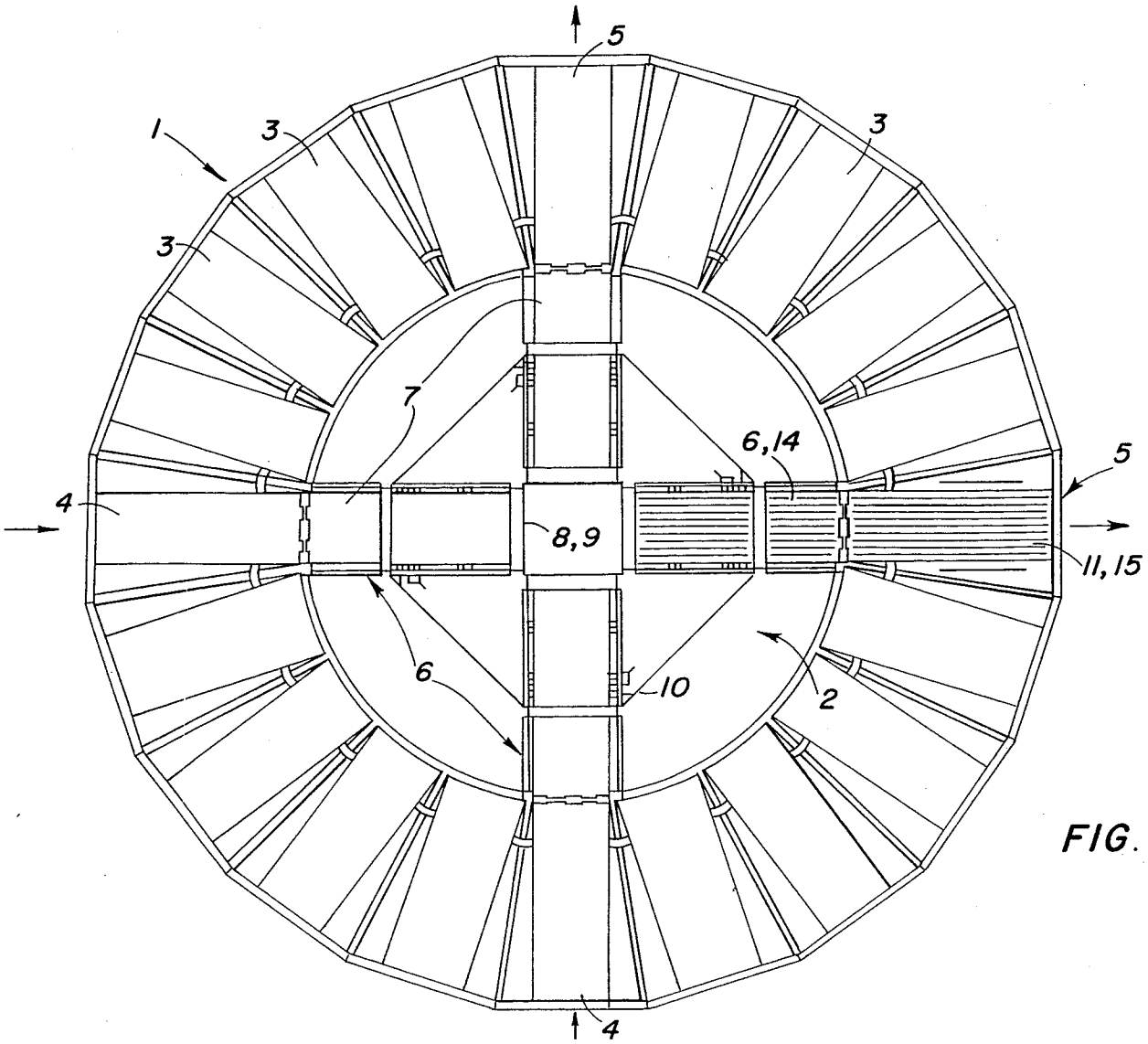
FIG. 2 is a top view of a parking device with several stations and a transport device for the depositing, parking, and removal of vehicles or items.
Figure 5:
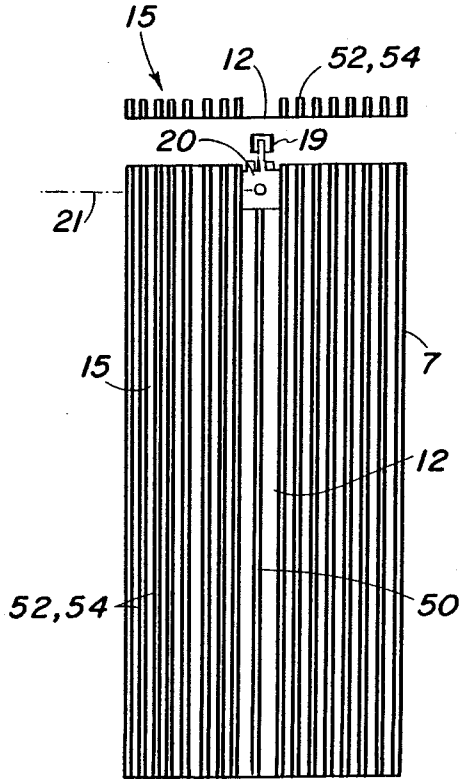
FIG. 5 is a top view of a transfer means.
Figure 4:
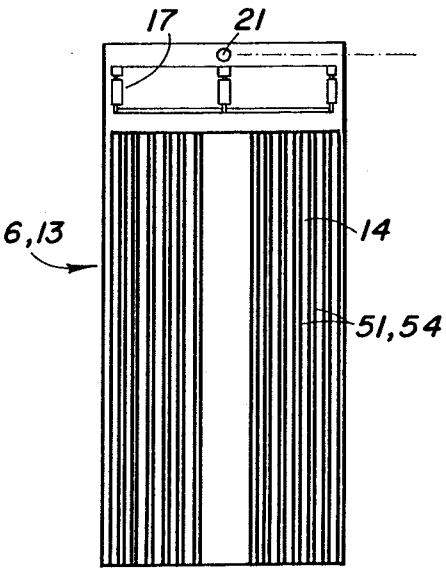
FIG. 4 is a top view of a transfer means.
Figure 3:
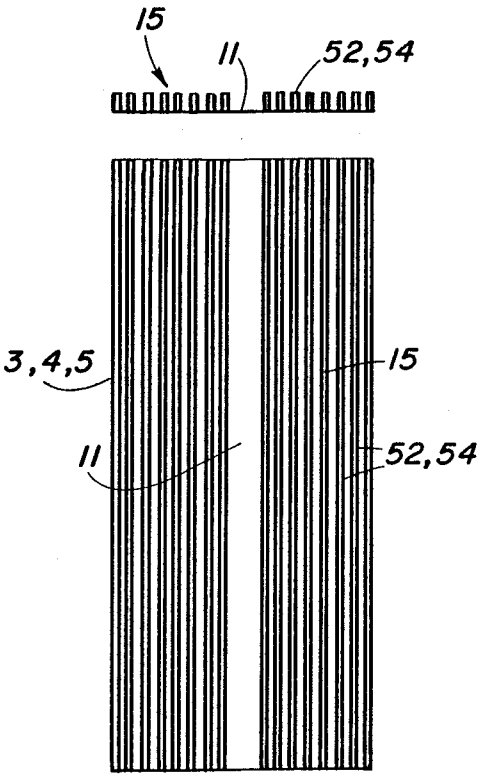
FIG. 3 is a top view of a transfer means.
Figure 14:
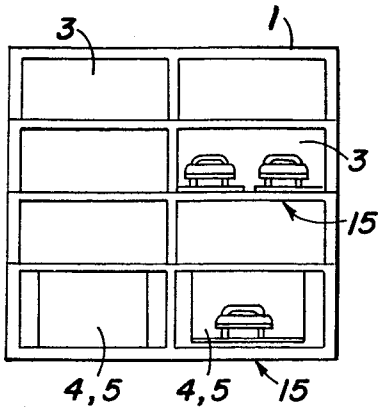
FIG. 14 is a detailed front view of the upper part of the central column of the transport device, shown in partial cross section according to FIG. 18.
Figure 16:
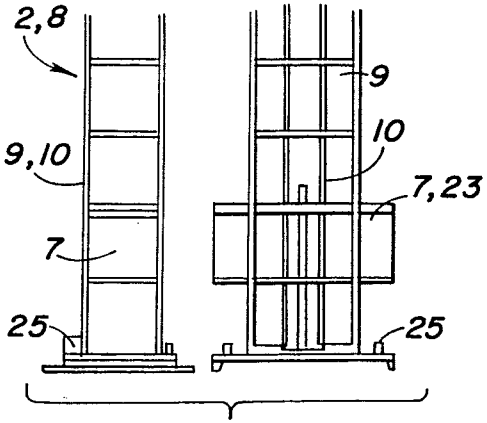
FIG. 16 is a front view of the central column of the transport device, showing center pieces used for the possible extension of the central column, according to the embodiment of FIG. 18.
Figure 18:
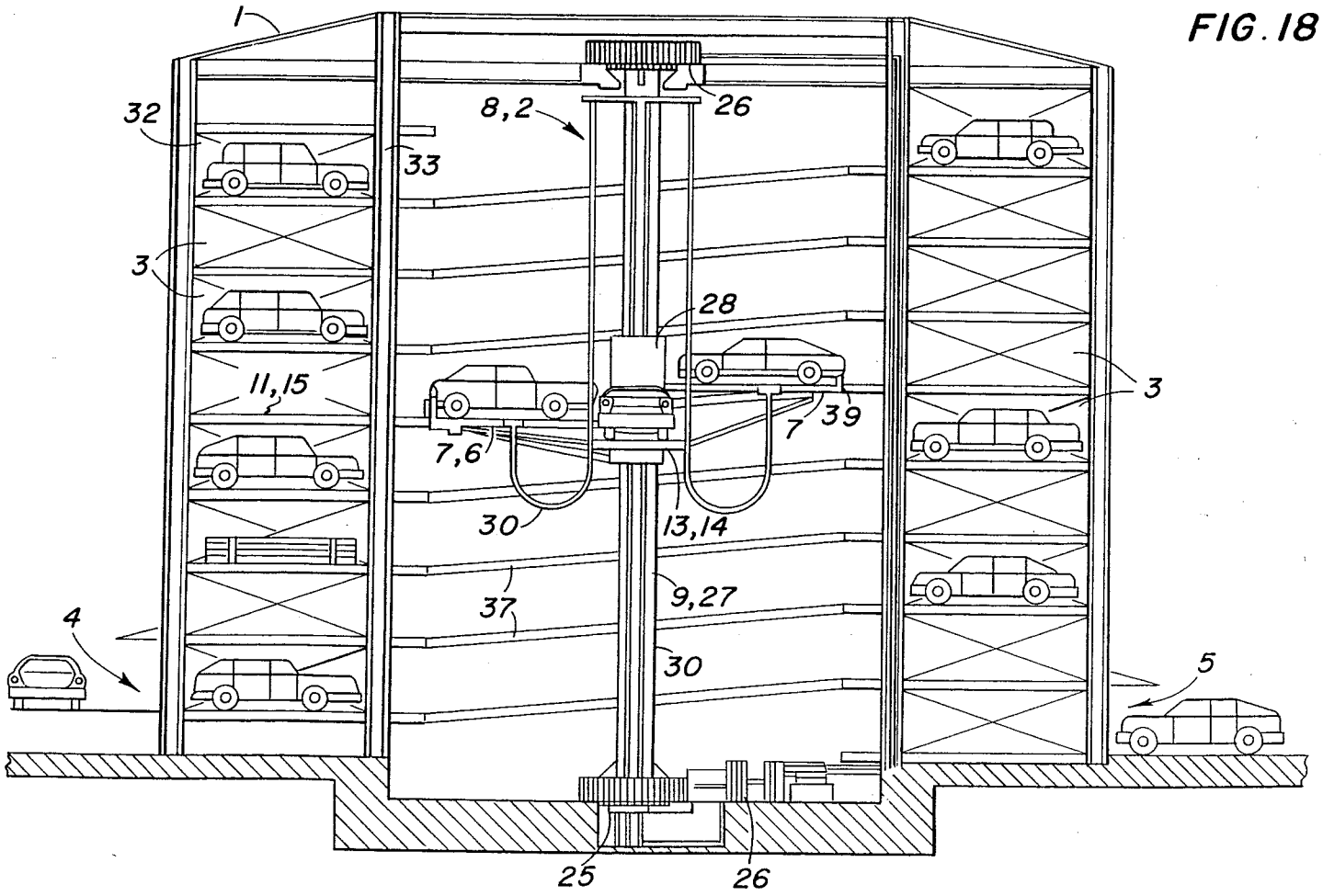
FIG. 18 is a front view of the sleeve or bushing of the transport device according to the embodiment of FIG. 18.
Figure 19:
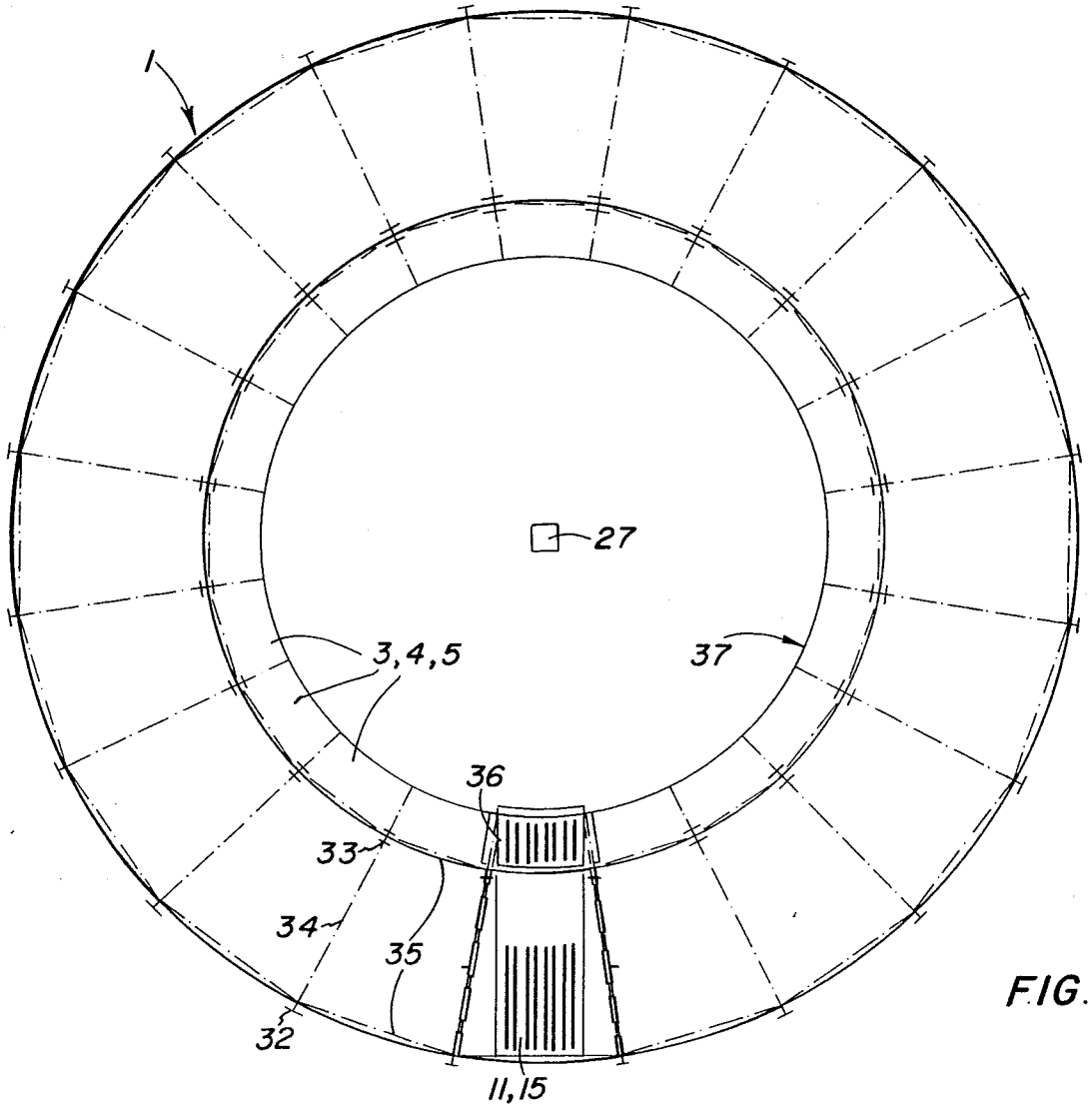
FIG. 19 is a detailed top view of the sleeve or bushing of the transport means according to the embodiment of FIG. 18.

FIGS. 1, 14 and 18 show the front view of a parking device 1 with several storage stations 3 to which the vehicles deposited at one or more deposit stations 4 are moved through a transport device 2 with a transfer device 6 The vehicle is removed through the inverse process and is picked up at the removal stations 5. In the embodiment according to the FIGS. 1, 2 and 18, 19 the parking device 1 has the shape of an essentially cylindrical tower, wherein the equally spread stations 3, 4, 5 surround the central transport device in an annular arrangement. In FIGS. 1 and 2 the stations 3 are superposed in several separate levels, the transport device 2 for the distribution of the vehicles executing rotating movements as well as lifting and lowering movements. In the embodiment shown in FIGS. 18 and 19 the stations 3, 4, 5 are arranged on a continuous level turning upward in a helical or spiral form. The transport device 2 also executes rotating movements as well as lifting and lowering movements, but due to the helical path they are coupled. In FIGS. 1 and 2 the movements are independent of each other.

FIG. 14 shows a parking device 1 with a linear arrangement of the stations 3, 4, 5 in one or several rows above and/or next to one another. Accordingly the transport device 2 executes linear sliding movements and/or lifting and lowering movements. Herein a row of stations 3, 4, 5 may be arranged on both sides of the transport device 2 (see FIG. 17).

In all embodiments the transport means 2 comprises a conveyor means 8 with one or several transport boxes 7, in which the vehicles are moved forward and backward between the stations 3, 4, 5. By means of a transfer device 6. The vehicle is removed through the inverse resp. removed from them.

The transfer device 6, according to the FIGS. 3 to 13, consists of one or several transfer plates 13 with profiled transfer grates 14 and of corresponding station grates 15 in the various stations 3, 4, 5. The vehicles stand on the transfer grates 14 and the station grates 15. The design of the station grates 15 is identical in all stations 3, 4, 5, so that the deposit stations 4 may also be used as removal stations 5 and reverse. The transfer plates 13 are usually allocated to the transport boxes 7, each of transfer plates having its own transport box.

In the shown embodiments the transfer grates 14 and the station grates 15 have the shape of multi-armed grates with complementary profilings. In addition the grates 14, 15 are open at least to one side, so that the transfer grates can enter the station grates 15 in vertical direction. The grates 14, 15 can also slide into one another in their longitudinal direction.

Figure 13:
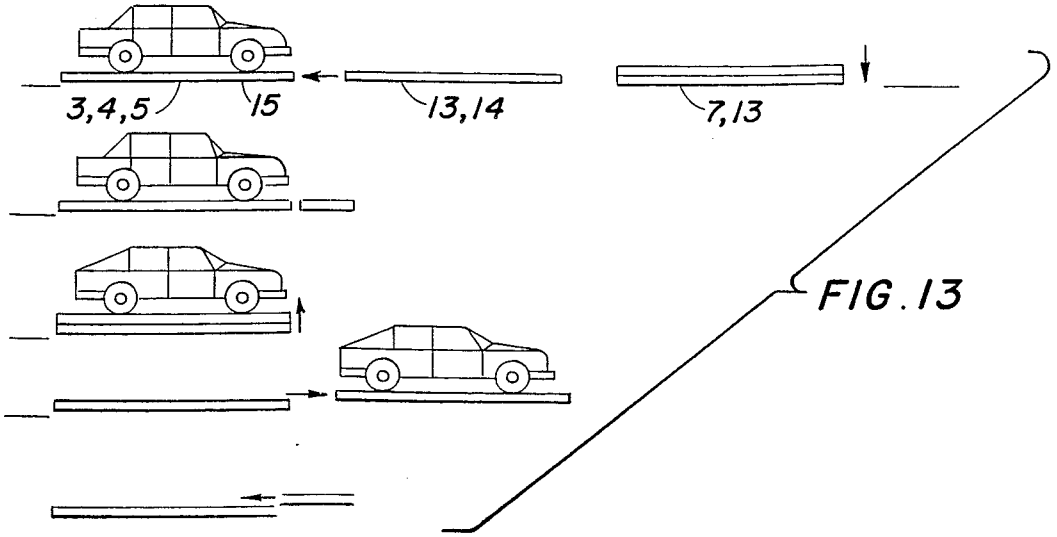
FIG. 13 is a diagrammatical representation explaining the transfer process.

Before the description of design details the function of the transfer device 6 will be explained on the basis of FIG. 13. For the removal of a vehicle from a station 3, 4, 5 the transport box 7 with the transfer plate 13 is positioned opposite the station. The transfer plate 13 with its transfer grate 14 is moved into or under the station grate 15. During the following lifting movement the transfer grate 14 goes through the station grate 15, slides under the vehicle wheels and lifts it off the station grate 15. Then the transfer plate 13 with the lifted transfer grate 14 is moved back onto the transport box 7 and lowered if necessary. The procedure is reversed when the vehicle is deposited in the station. The transfer plate 13 with the lifted vehicle is moved into the station. Then the transfer grate 14 is lowered through the station grate 15, so that the vehicle stands on the latter. Once the transfer plate 13 is withdrawn, the transfer process is completed and the transport box 7 can be moved to a different station to pick up another vehicle.

The transfer device 6 has corrugation-shaped grates 14, 15. The grate arms 54 are arranged parallel to one another spaced a distance to one another and parallel to one another in the longitudinal direction of the sliding movement. The grate arms consist of box-section or U-section of steel 51, 52. For the station grate 15 the grate profiles 52 are set on a solid and continuous floor 11 A larger space is left in the middle than between the other grate profiles 52.

Other than the grate 14 the transfer plate 13 also has a traversing mechanism 16 and a lifting device 17 for the grate arms 54 and a drive 19 for the transfer movement With this design the bottom 12 of the transport box 7 also features a grate 15 corresponding to the grate of the station 3, 4, 5 and which is in alignment in the transfer position of the transport box. The transfer grate 14 is therefore always moved in a rail-like manner, during its homeposition in the transport box 7 as well as during the transfer process.

The drive 19 is in the form of a motor 19 arranged at the end of the transport box 7, which actuates a slide 20 through a spindle 50. The spindle 50 extends inside and along the widened central groove of the grate 15. The slide is engaged with a traverse at the rear end of the lifting device 17 through a peg guide 21. The lifting device 17 connects the freely corbelling out arms 54 of the transfer grate 14 to one another at their backward end.

The movement of the slide 20 is therefore transformed into a linear transfer movement of the grate 14. The size of the deposit surface available for a vehicle is determined by the length of the transfer grate 14, which is a little shorter than the length of the two grates 15 for a complete transfer. The transfer grate does also have an enlarged space in the middle.

Figure 6:
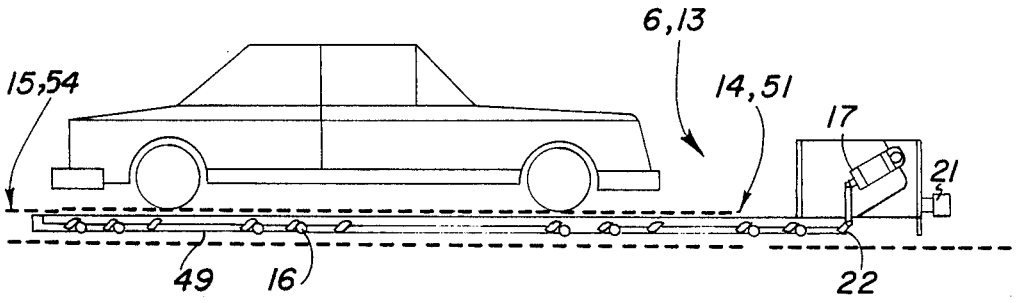
FIG. 6 is a side view showing a vehicle in a position to be lifted.
Figure 7:
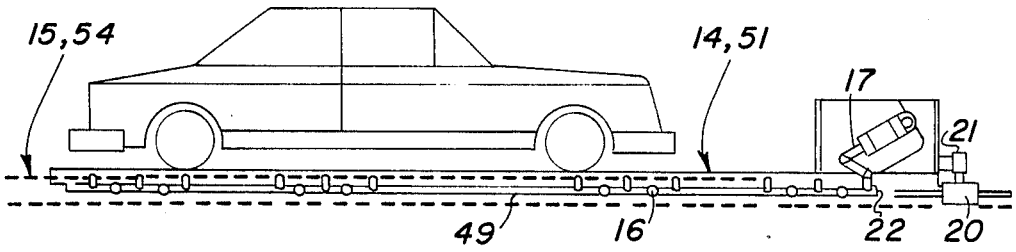
FIG. 7 is a side view of the transfer plate in FIG. 6 showing the vehicle in a lifted position.

Below the U-shaped profiles 51 of the transfer grate 14 running gears 16 are arranged, by means of which the profiles on the floor 11, 12 roll during the transfer movement in the spaces of the grates 15. In the embodiment according to FIGS. 6 and 7 the running gears 16 comprise a housing 49, here in the shape of a rod, for each roller, which is encroached by the grate profiles 51. The housings 49 are connected to a hydraulic cylinder or another drive of the lifting device 17 through a toggle lever gear 22 and also to the grate profiles through small swivelling levers 51. As shown in FIG. 6, the grate profiles 51 sit on the housing 49 when the lifting device 17 is relaxed, so that their surface is below the surface of the station grates 15. If the lifting device 17 according to FIG. 7 is actuated, the toggle lever gear 22 pulls the housing 49 with the rollers backward with regard to the grate profiles 51, herein the grate profiles 51 are lifted above the level of the station grate 15 through a swivelling movement of the small swivelling levers. Herein also the housing of the lifting device 17 connected to the transfer grate 14 is lifted. The peg guide 21 remains engaged, so that the transfer grate 14 can be moved back onto the transport box 7 by means of the drive 19. The housing of the lifting device 17 has recesses in the area of the arms 54 of the two grates 15, so that it can move over the grates 15 even in its lowered position.

Variations of the shown embodiment are possible by means of kinematic reversal, wherein the lifting device 17 is rigidly connected to the running gear 16 and acts on the grate profiles 51. In the shown embodiments the longitudinal direction of the vehicles coincides with the transfer direction, resp. the longitudinal direction of the grates 14, 15. However, the vehicles can also be arranged at a right angle with regard to the longitudinal direction of the transfer and grate direction. Then the grates are shorter and wider. This version allows for shorter transfer distances.

Figure 8:
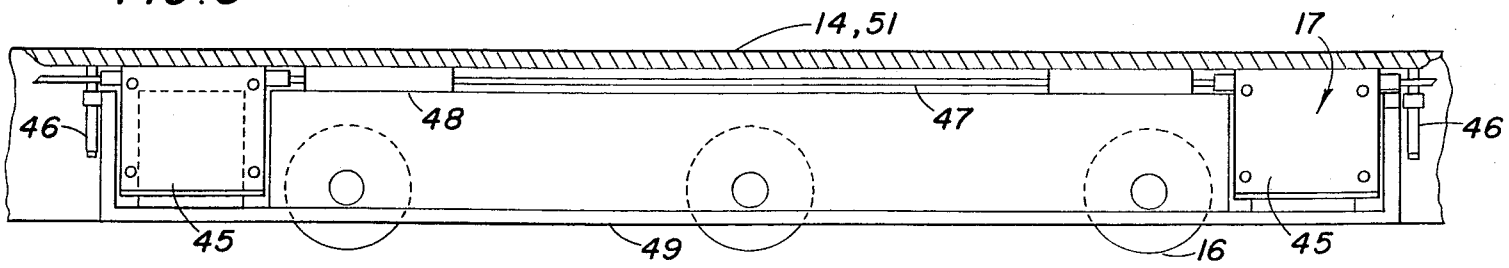
FIG. 8 is a cross sectional enlarged detail view o the transfer plate of FIG. 6.
Figure 9:
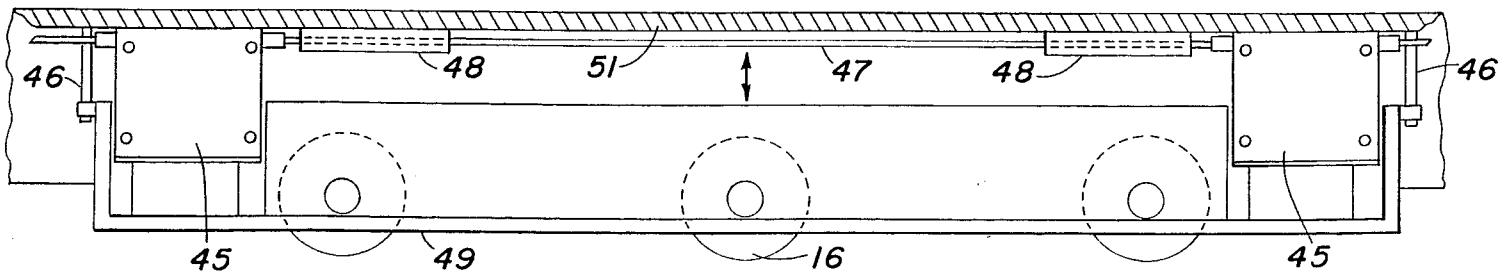
FIG. 9 is a cross sectional enlarged detail view of a version of the transfer plate of FIG. 7.

FIGS. 8 and 9 show a variation with regard to the running gears 16 and the lifting device 17. The running gear groups, of which three are arranged under each profile 51 (see FIG. 11), have a box-shaped housing 49, which is encroached by U-shaped profiles 51. At the ends of the housing 49 angle modules with open tops are arranged, in which rectangular hydraulic cylinders 45 of the lifting device 17 are fitted with adequate play. On the outside two catch webs 46 are arranged for the guidance and limitation of the lifting movement. The profiles 51 are screwed together with the outer part of the hydraulic cylinders 45 on the outside of the latter with countersunk screws to reduce the spreading forces on the U-shaped profiles 51 under extreme loads. Through the hydraulic cylinders 45 and the angle modules the running gears 16, too, are led into the longitudinal direction relative to the grate profiles 51. Hydraulic lines 47 for the pressure supply of the cylinders 45 are arranged in the longitudinal direction between the housing 49 and the grate profiles 51. The lines 47 are prevented from being crushed by distance blocks arranged near the cylinders, which also reduce the vibration forces in the lowered position of the grate profiles 51. Upon operation of the hydraulic cylinders 45 the transfer grate 14 is lifted. Herein the multitude of cylinders can generate extreme lifting power.

Figure 10:
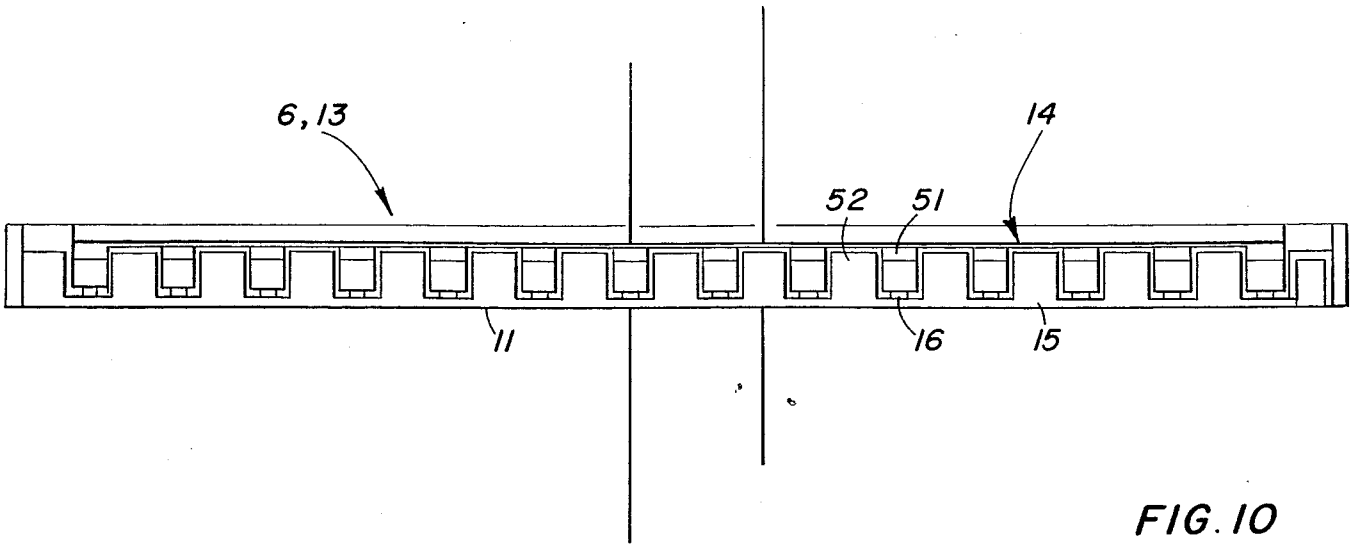
FIG. 10 is a front view of a transfer plate.
Figure 11:
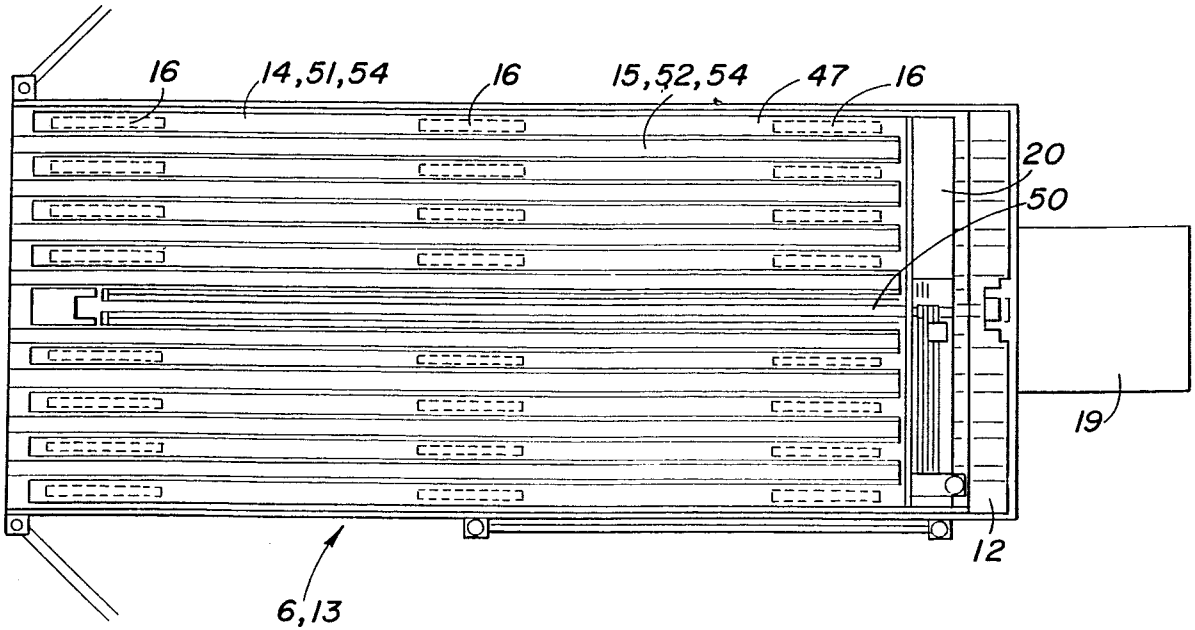
FIG. 11 is a top view of a transfer plate variation according to FIGS. 8 and 9 at a first stage of the operation.
Figure 12:
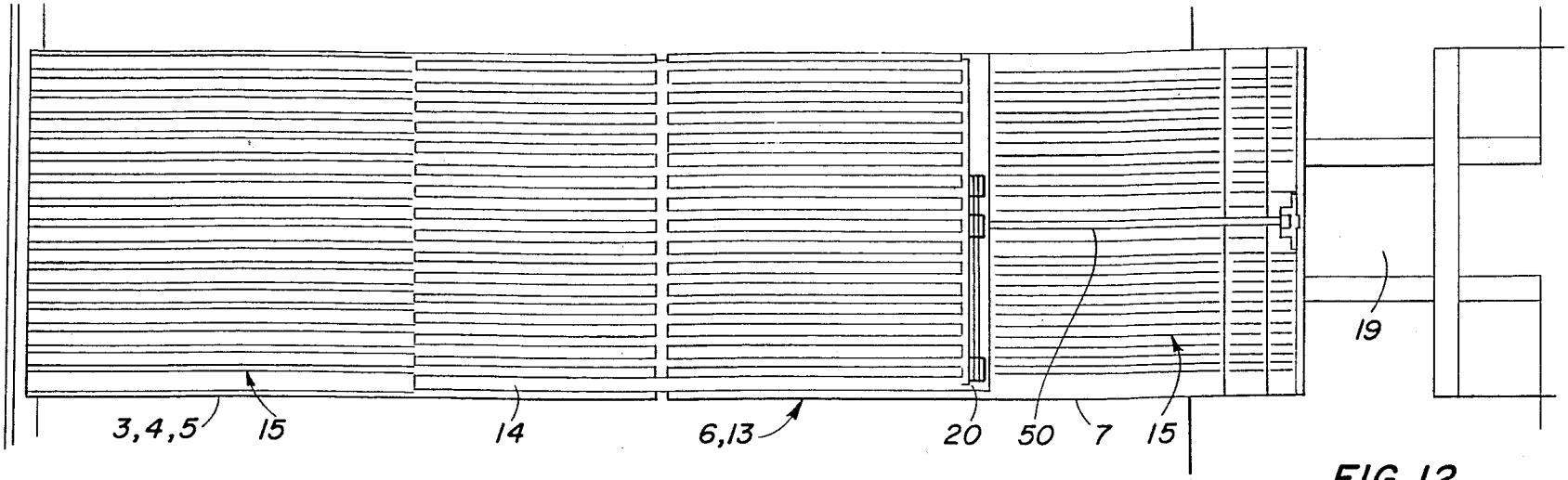
FIG. 12 is a top view of the transfer plate variation according to FIGS. 8 and 9 at a second stage of the operation.

The profile grates 51 are connected on the back by means of a traverse, which serves at the same time as a slide 20 for the transfer drive 19 (see FIG. 11). The slide 20 is engaged with a spindle 50. The slide 20 also comprises the central hydraulic supply and distribution for each cylinder 45. FIG. 10 shows the arrangement described above in front view, while FIGS. 11 and 12 are top views in operation and in a home position.

The transfer device 6 transfers the vehicle while it is standing, and it does not require any exact positioning in the deposit station 4. During the transport the vehicle can neither tip nor roll nor change its position in any other way. The partition of the grates 14, 15 in the embodiments 3 to 12 is chosen so that a safe position of the vehicle wheels is guaranteed at all times during the transfer from one grate to the other.

Figure 17:
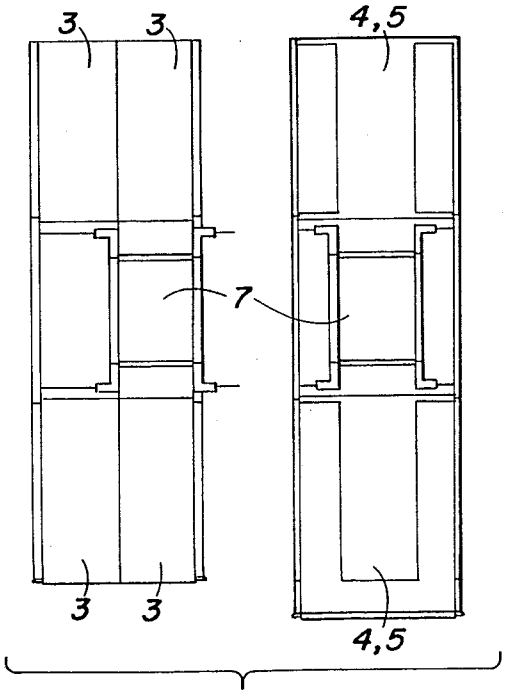
FIG. 17 is a detailed front view of the lower part of the central column of the transport shown in partial cross-section, according to the embodiment of FIG. 18.
Figure 15:
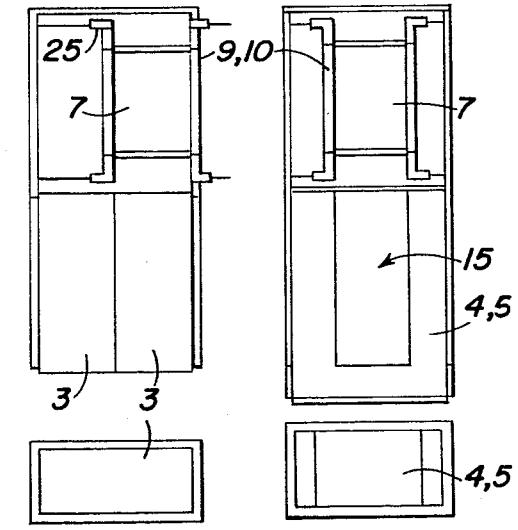
FIG. 15 is a detailed top view of a sleeve or bushing of the central column of the transport device, according to embodiment of FIG. 18.

FIG. 14 shows a parking unit 1 in front view with deposit and/or removal stations 4, 5, which have the same width and length as a double storage station 3. Therefore the stations 3, 4, 5 form modules which can be combined at will in a unit construction system and a corresponding transport device. In FIG. 15 this arrangement is shown in top view for a single-row parking unit 1, while FIG. 17 shows a double-row parking unit 1 with a transfer device 6 working on both sides. Due to the large deposit and removal stations even inexperienced drivers have no problem to drive the vehicle in any position onto the deposit area determined by the size of the grate in the deposit station 4. The passengers can get out of the car easily and leave the station by means of foot paths arranged on both sides. The removal station 5 is built in the same way. The stations 4, 5 can be used for depositing a car as well as for picking it up. Therefore, all stations can be used at all times according to the requirements.

The stations 3, 4, 5 and the transport device 2 with transfer device 6 can be installed in a stationary building or they can be executed as a steel construction in a unit construction system. Such parking units 1 according to FIGS. 14 to 17 can be extended at will in width or height and they also allow for a volume extension by transformation from a single-row arrangement to a double-row arrangement according to FIG. 17. The cylinder tower according to FIGS. 18 and 19 can also be extended in height by additions. The parking units 1 with their various parts are controlled by a central computer, which manages the deposit stations 3 and which moves the transport device 2 with the transport boxes 7 correspondingly.

The conveyor device 8 of the parking unit 1 of FIGS. 1 and 2 consists of a tower-shaped frame 9, which is lowered in the ground and mounted rotatably on a bearing ring (turntable) 25. Its rotation is effected by a drive 26. Four lifting devices or elevators 10 are arranged crosswise in the frame 9, which move two-story transport boxes 7 up and down. Herein each transport box comprises its own transfer device 6, so that 8 vehicles can be stored or picked up simultaneously. Even with a breakdown of single components the device can still be operated. It offers optimal access time as various lifting and rotating movements of the transport device 2 can be effected at the same time. On the first floor a smaller or larger number of deposit and storage stations 4, 5 can be arranged depending on the traffic and the desired access time. These can be defined as deposit stations or removal stations or can be used as required. A barrier bars the entrance and opens for the vehicle only once a transport box is ready for its reception. The two-story transport boxes 7 are loaded and unloaded in two steps, the box being lowered or lifted in the process. It is also possible to provide entrances and exits 4, 5 on two stories or even more in correspondence with the transport boxes 7 and therefore to load all transport boxes 7 simultaneously. During the following transport cycle the frame 9 rotates, and at the same time the transport boxes 7 are lifted to the desired height. A computer-supported and optimized management allows for the loading of all transport boxes 7 at the storage stations 3 in a single cycle and during the next cycle a complete transfer at the entrances and exits 4, 5.

The embodiments according to FIGS. 14 to 17 differ from the above mainly in their linear arrangement, wherein the frame 9 consists mainly of one or several towers arranged adjacent to one another, which operate either separately or they are connected through running gear arrangements or longitudinal drives 25' along a row of stations. The conveyor device 8 can also be a scissor-type lift, which is economical and sensible especially for separate superimposed modules.

Figure 27:
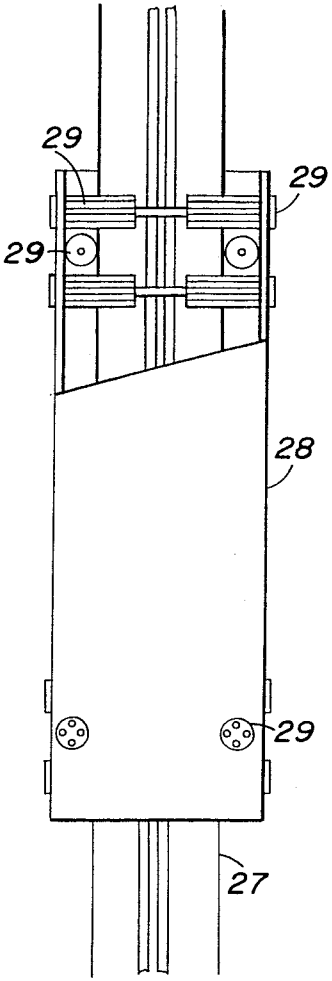
Figure 29:
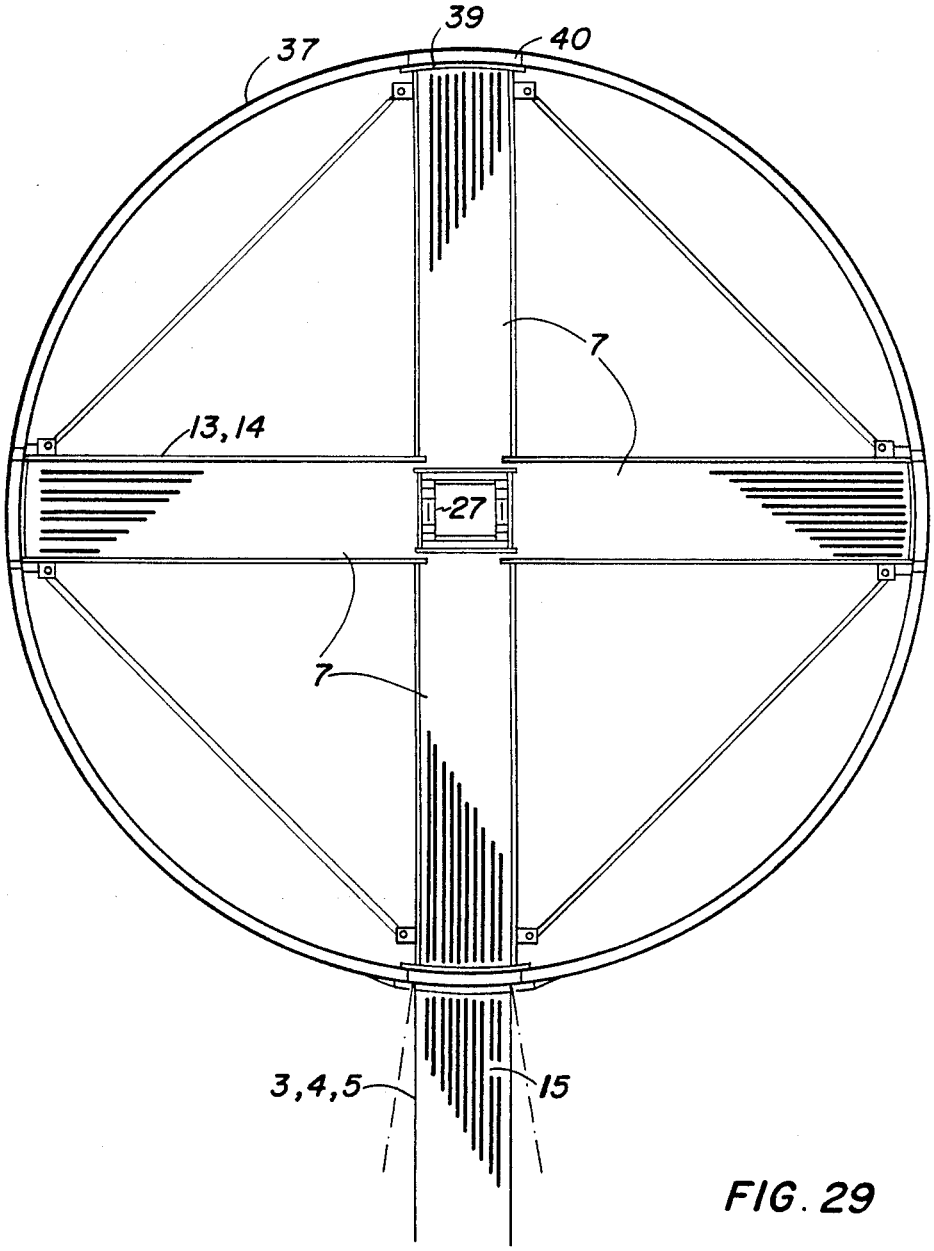

In the example according to the FIGS. 27 and 29 the frame 9 comprises a hollow central column 27, which is rotated by means of a hydraulic drive 26 or such like. Here the lifting device has the shape of a sleeve or bushing 28, on which four transport boxes 7 in the shape of platforms are mounted offset with regard to one another by a quarter of the spiral height of a 360° segment. The transport boxes 7 are connected to one another by means of supporting stays (see FIG. 29). The central column 27 and the sleeve 28 have a rectangular or a square cross section, the sleeve 28 being mounted longitudinally movable on the central column through roller bearings 29 and guided rotatably. The transport boxes 7 have running gears 39 at their free ends, by means of which they are supported on a helical guide rail 37. With a rotating movement of the central column 27 the sleeve 2 and its transport boxes 7 are moved up or down in a spiralling line. The storage stations 3 are arranged adjacent to one another in steps along the spiralling line. Herein the next story is reached after 360°.

Figure 20:
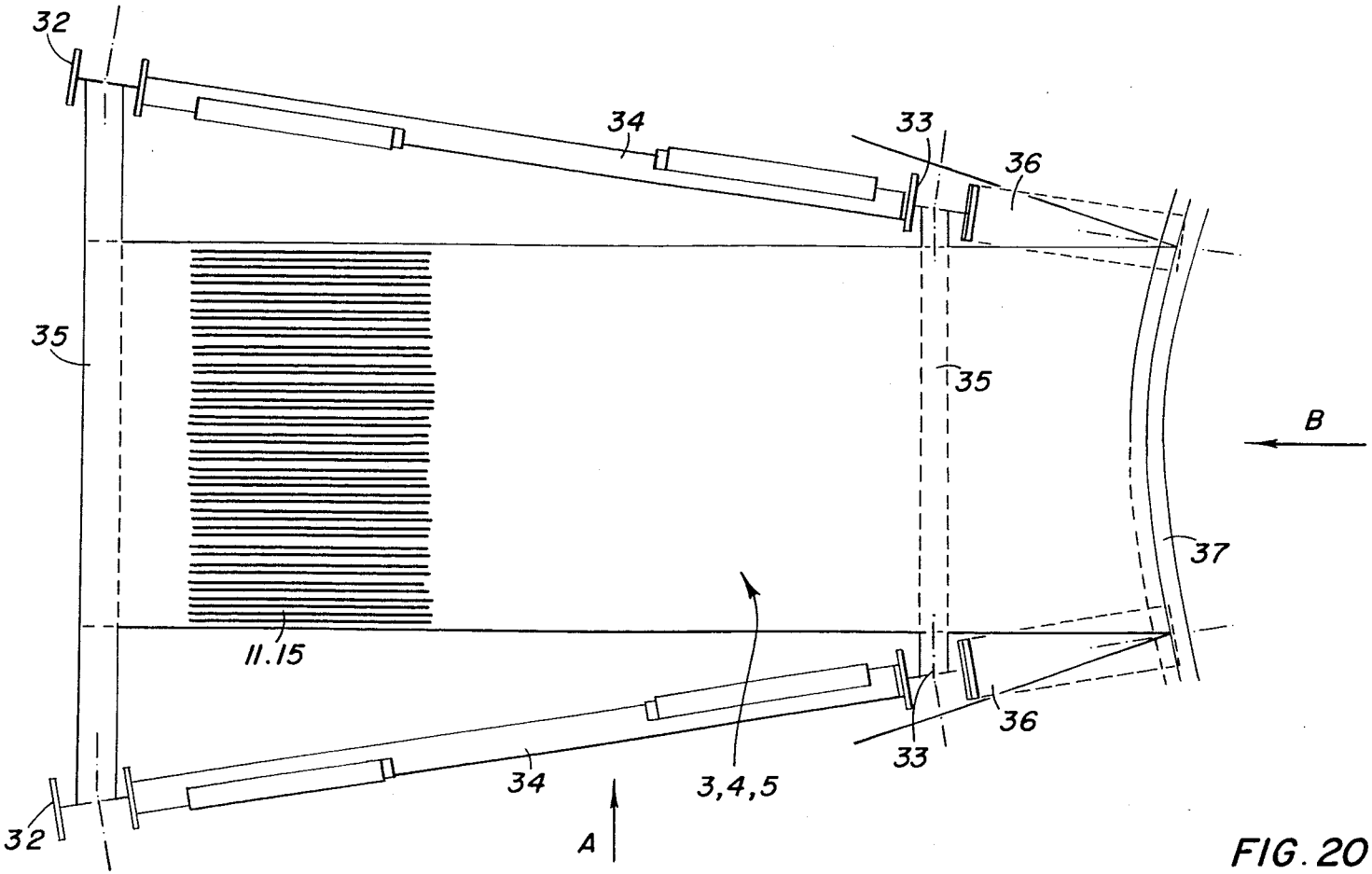
FIG. 20 is a top view showing the running gear of the transport boxes according to the embodiments of FIGS. 18 and 19.
Figure 21:
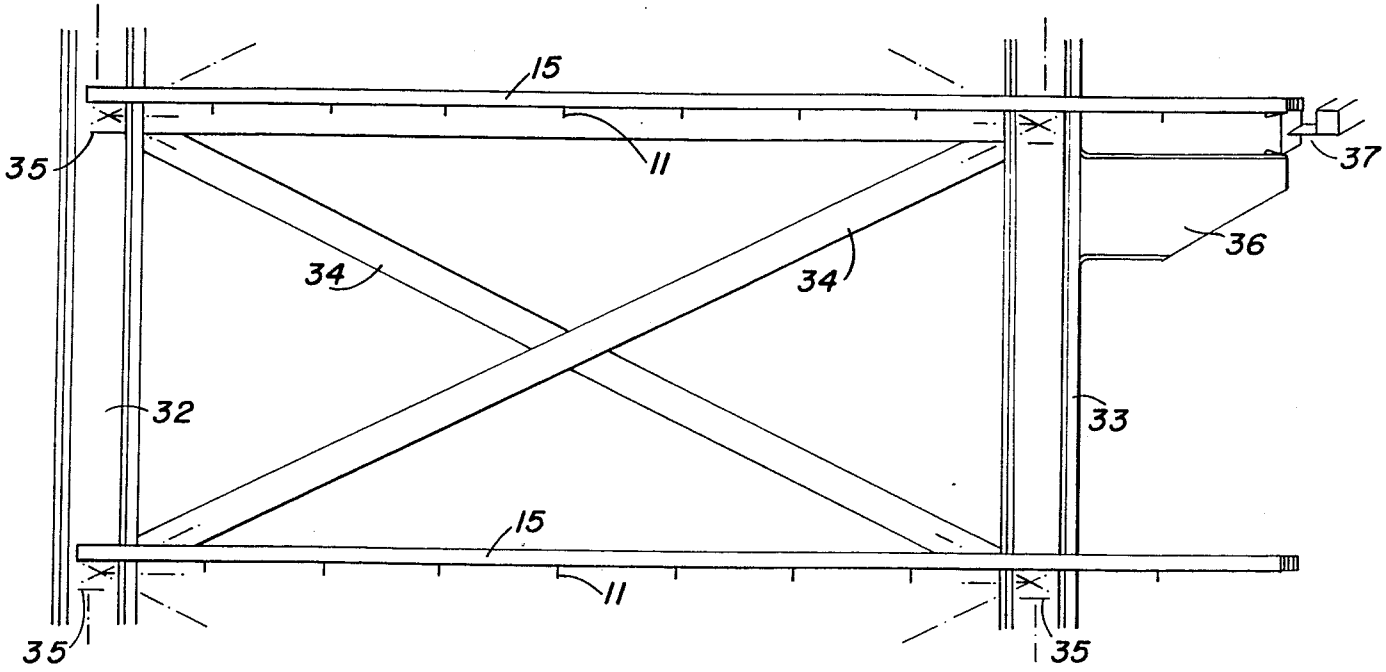
FIG. 21 is a side view showing the running gear arrangement of the embodiment according to FIGS. 18 and 19.
Figure 22:
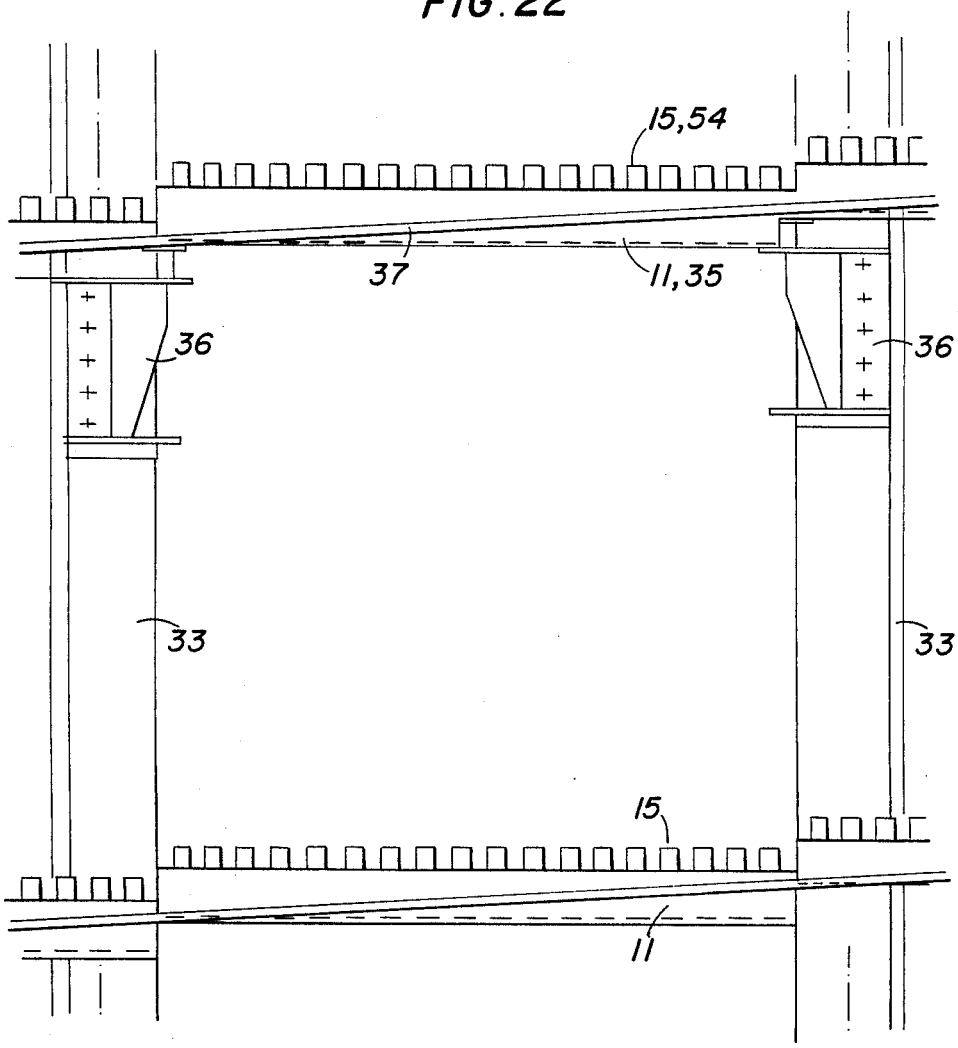
FIG. 22 is a front view of the running gear and transport box arrangement of the embodiment of FIGS. 18 and 19.
Figure 23:
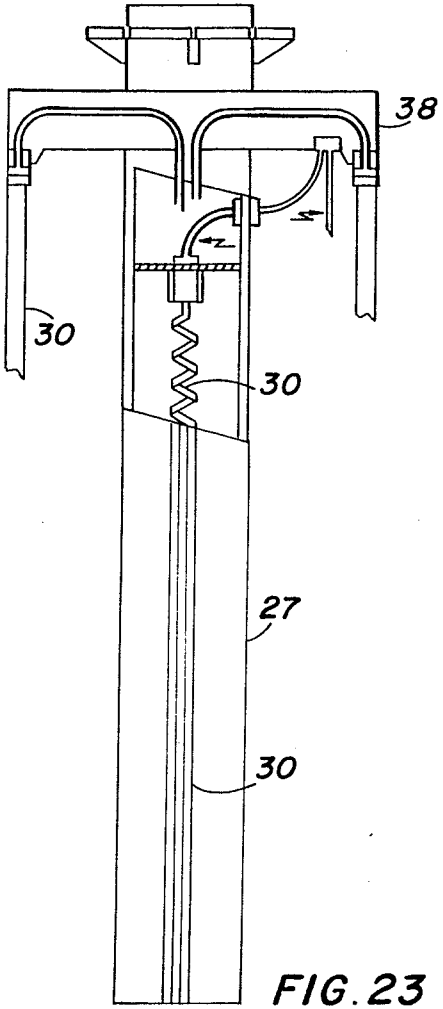
Figure 28:
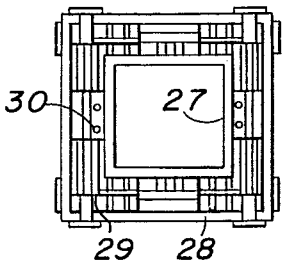

FIGS. 20 to 22 show the storage stations 3 in module construction. Between annularly arranged vertical stays 32 traverses 35 are mounted (compare FIGS. 18 and 19). The inner stays 33 arranged in an inner ring are connected to one another in the same fashion. Stiffness in radial direction is achieved by diagonal traverses 34 between neighboring stays 32, 33. The floor 11 with the station grate 15 rests on the traverses 35. It protrudes a little over the stays 33 and is mounted on radial support flanges 36 at its end. The support flanges also carry the helical guide rail 37, which runs at an angle with regard to the horizontal station grates 15 (FIG. 23). As FIG. 29 shows, the ends of the grates 14, 15 are bevelled in correspondence with the guide rail 37 for an accurate transition.

Figure 25:
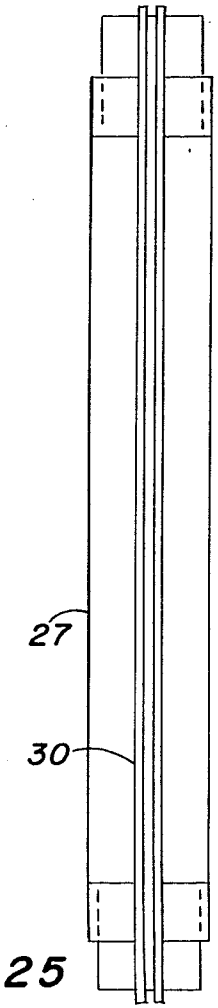
Figure 24:
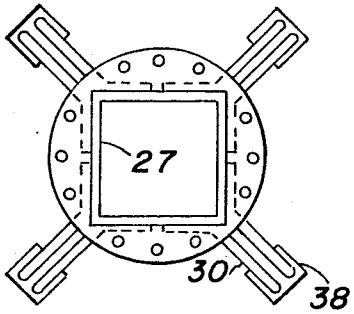
Figure 26:
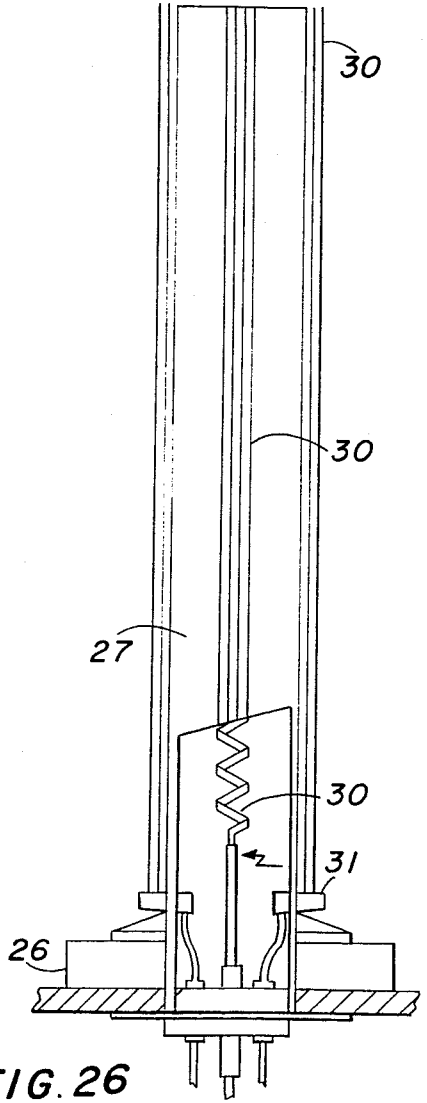

The shown steel construction with the module construction system for the stations 3, 4, 5 allows for an extension of the parking unit 1 at will. The central column 27 is designed in several parts accordingly. The upper part shown in FIG. 23 has arms 38, over which the hydraulic-, energy supply- and signal lines 30 are led in a loop to the transport boxes 7 with their transfer devices 6. The current- and hydraulic lines 30 are led up from the bottom along the central column 27 on its outside and are encroached by the respective roller bearings 29 in the area of the sleeve 28. The sensitive signal lines 30 ar led through the inside of the column 27 and only in the head part are they led out through the arms 38. The bottom part of the column 27 shown in FIG. 26 has a toothed gear for the connection with the drive 26. The lines 30 on the outside are led into the interior of the central column 2 by means of a ring coupling 31 and through elastic line parts to a stationary supply point. For the adjustment of any column height center pieces are provided according to FIG. 25, which are coupled with the other column parts by means of a plug connection. Respective couplings can be provided for the lines 30.

Figure 30:
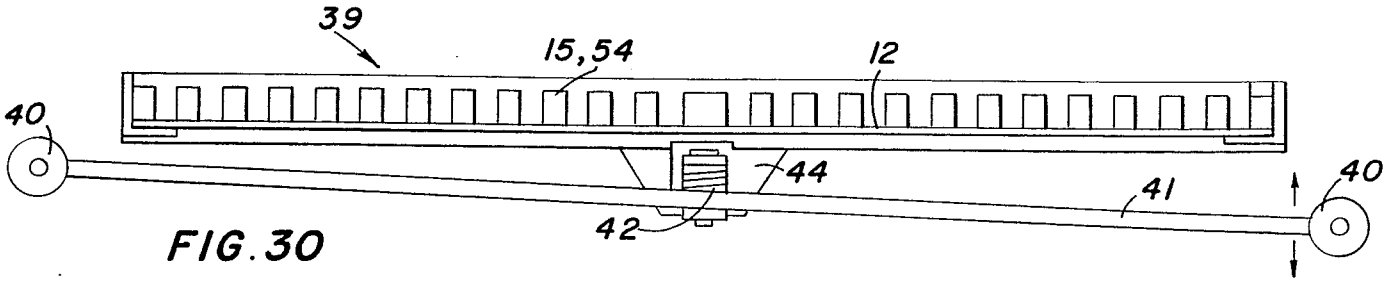
Figure 32:
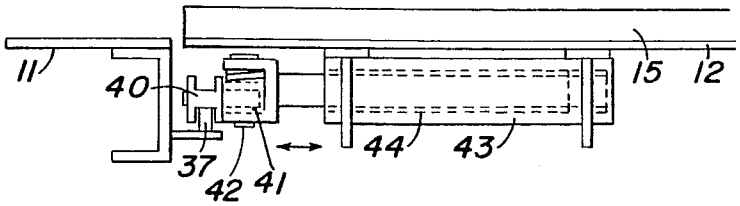
Figure 31:
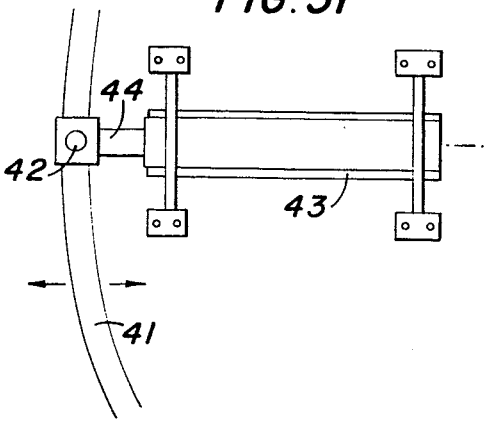

FIGS. 30 to 32 show the running gear 39, with which the transport boxes 7 are guided on the guide rail 37. The running gear 39 comprises two rollers 40 encroaching the guide rail form-lockingly, which are mounted on a connecting rod 41 with a C-shaped cross section and bent according to the guide rail 37. The connecting rod 41 is connected to the C-flange of a bearing rod or mounting bar through a vertical kingpin 42 (see FIG. 32) which is clamped by a pressure spring. The bearing rod 44 is longitudinally movable and rotatable in a guide sleeve 43, which is flanged centrally onto the bottom 12 of the transport boxes 7. The running gear 39 does therefore represent a 4-way suspension, which features several degrees of freedom due to the rotation and sliding of the bearing rod 44, the spring-biassed height offset of the connecting rod 41 at the kingpin 42 as well as the rotation around the kingpin 42. Herein irregularities in the helical path of the guide rail 37 can be compensated for, which may be caused by constructive tolerances, dirt accumulation, wind, temperature changes etc.

While specific embodiments of the invention have been shown and described in detail to illustrate the application of the principles of the invention, it will be understood that the invention may be embodied otherwise without departing from such principles.

I claim:

1. A storage device comprising:

a deposit station; a removal station; and plurality of storage stations having a deposit and removal opening; transport means for transporting an item from adjacent the deposit station to adjacent one of said plurality of storage stations and for transporting an item from adjacent one of said plurality of storage stations to adjacent the removal station said transport means including a transport floor with grate elements defining intervening floor running support surfaces; and, transfer means for transferring the item from adjacent one of said plurality of storage stations to within one of said plurality of storage stations and for transferring an item from within one of said plurality of storage stations to adjacent one of said plurality of storage stations, said transfer means including a transfer grate having parallel grate arms connected to each other by a ty-bar, a lifting mechanism connected to the grate arms and a traversing mechanism connected to each grate arm, said traversing mechanism including running gears for moving the transfer grate horizontally, each of said stations including a station floor having grate elements defining intervening floor running support surfaces, each of the transport means floor grate elements and station floor grate elements interfitting with the grate arms of the transfer grate, said transfer grate arms running gears being engageable with each of said transport floor and station-floor running support surfaces so that the transfer grate may be moved into the station grate elements and lifted and lowered with respect to the station grate elements.

2. A storage device according to claim 1, wherein each of the grate arms of the transfer grate lifting mechanism is attached to three running gears of the traversing mechanisms.

3. A storage device according to claim 1, wherein: said transport means includes at least one transport box with a station grate.

4. A storage device according to claim 1, wherein: the traversing mechanism includes a stationary drive associated with a transport box.

5. A storage device according to claim 1, wherein said lifting mechanism includes toggle lever gears.

6. A storage device according to claim 1, wherein: the lifting mechanism has several hydraulic cylinders, each of the hydraulic cylinders being arranged and guided in a housing in common with the running gears, each of the hydraulic cylinders being connected to a U-profile portion of the transfer grate.

7. A storage device according to claim 1, wherein: the transport means includes a rotatable platform which is moveable vertically for lifting and lowering an item, the platform having conveyor means for moving one or more multi-story transport boxes, each transport box being provided with said transfer means.

8. A storage means according to claim 7, wherein: the conveyor means has a rotatable and longitudinally moveable frame, one or more elevators with transport boxes being disposed in said frame.

9. A storage device according to claim 7, wherein: each of the storage stations is arranged in a vertical spiral around said conveyor means, said conveyor means having a rotatably driven central column with a sleeve or bushing supporting one or more transport boxes, said bushing being guided rotatably and axially moveable, said transport boxes being arranged radially and being supported and guided by a helical guide rail with a running gear.

10. A storage device according to claim 9, wherein: the running gear of the helical guide rail is connected to a bearing rod (44) by means of a spring-bias vertical king pin, the bearing rod being mounted longitudinally, movably and rotatably in a guide sleeve (43) or bushing on the floor of the transport box.

11. A storage device according to claim 9, wherein each of the stations is modular and the transport means and the transfer means and the transport box are each modular.

12. A storage device for automobiles, comprising:

a deposit station;

a removal station;

a plurality of storage stations each having a deposit and removal opening, each of said stations including a station floor having grate elements defining intervening floor running support surfaces;

transport means for transporting an automobile from adjacent said deposit station to adjacent one of said plurality of storage stations, said transport means including a transport floor with grate elements defining intervening floor running support surfaces, said transport floor being substantially identical to said station floor; and, transfer means for transferring an automobile from adjacent one of said plurality of storage stations to within one of said plurality of storage stations and for transferring an automobile from within one of said plurality of storage stations to adjacent one of said plurality of storage stations, said transfer means including a transfer grate having parallel grate arms extending in the direction of travel and along a longitudinal axis of an automobile being transported, each of said parallel grate arms being connected to each other by a ty-bar, a lifting mechanism connected to the grate arms and a traversing mechanism being connected to each grate arm, said traversing mechanism including running gears for moving the transfer grate horizontally, said running gears being engageable with each of said transport floor and station floor running support surfaces.

13. A storage device for automobiles according to claim 12, wherein said running gear includes a running gear set connected to the grate arms by a fist lifting means at one end of the grate arms and a second lifting means at a second end of the grate arms.

* * * * *

UNITED STATES PATENT AND TRADEMARK OFFICE

CERTIFICATE OF CORRECTION

PATENT NO. : 4,976,580

DATED : December 11, 1990

INVENTOR(S) : Knakrick

It is certified that error appears in the above-identified patent and that said Letters Patent is hereby corrected as shown below:

On the title page

Please change the foreign application priority data from:

Feb. 22, 1986 [DE] Fed. Rep. of Germany...8620486 [U].

to:

Aug. 22, 1986 [GB] Great Britain...8620486

Signed and Sealed this

Eighteenth Day of August, 1992

*Attest:*

DOUGLAS B. COMER

*Attesting Officer*

*Acting Commissioner of Patents and Trademarks*